US006336950B1

(12) United States Patent
Koizumi et al.

(10) Patent No.: US 6,336,950 B1
(45) Date of Patent: Jan. 8, 2002

(54) ELECTRODE ROD FOR SPARK DEPOSITION, PROCESS FOR THE PRODUCTION THEREOF, AND PROCESS FOR COVERING WITH SUPERABRASIVE-CONTAINING LAYER

(75) Inventors: Mitsue Koizumi, 17-11, Midorigaka 4-chome, Toyonaka-shi, Osaka; Manshi Ohyanagi, I-505, 108-11, Minamigasa-cho, Kusatsu-shi, Shiga; Satoru Hosomi, Oyama, all of (JP); Evgeny Alexandrovich Levashov, Moscow (RU); Alexander Gennadievich Nikolaev, Moscow (RU); Alexander Evgenievich Kudryashov, Moscow (RU)

(73) Assignees: The Ishizuka Research Institute Ltd., Kanagawa (JP); Moscow Steel and Alloys Institute, SHS-Center, Moscow (RU); Mitsue Koizumi, Osaka; Manshi Ohyanagi, Shiga, both of (JP)

( * ) Notice: Subject to any disclaimer, the term of this patent is extended or adjusted under 35 U.S.C. 154(b) by 0 days.

(21) Appl. No.: 09/509,666

(22) PCT Filed: Jul. 17, 1998

(86) PCT No.: PCT/JP98/03237

§ 371 Date: May 5, 2000

§ 102(e) Date: May 5, 2000

(87) PCT Pub. No.: WO99/18258

PCT Pub. Date: Apr. 15, 1999

(30) Foreign Application Priority Data

Oct. 3, 1997 (JP) ..... 9-270996

(51) Int. Cl.[7] ..... C22C 29/00

(52) U.S. Cl. ..... 75/236; 75/243; 75/244; 419/11; 419/12; 419/13; 419/14; 419/40; 419/41; 419/42; 419/48; 427/580; 219/76.13

(58) Field of Search ..... 75/236, 243, 244; 419/11–14, 40, 41, 42, 48; 427/580; 219/76.13

(56) References Cited

U.S. PATENT DOCUMENTS

| | | | | | |
|---|---|---|---|---|---|
| 4,551,603 | A | * | 11/1985 | Rocklin | 219/76.13 |
| 4,649,086 | A | * | 3/1987 | Johnson | 428/627 |
| 5,030,818 | A | * | 7/1991 | Dudas | 219/69.12 |
| 5,102,031 | A | * | 4/1992 | Heitman et al. | 228/175 |
| 5,316,718 | A | * | 5/1994 | Sekhar | 419/19 |
| 5,458,334 | A | * | 10/1995 | Sheldon et al. | 273/167 R |
| 5,649,278 | A | * | 7/1997 | Dunmead et al. | 419/2 |

* cited by examiner

*Primary Examiner*—Ngoclan Mai
(74) *Attorney, Agent, or Firm*—Larson & Taylor PLC

(57) ABSTRACT

An aspect of this invention is an electrode rod for spark alloying, comprising a compact of a first powder of a first component which comprises a metal selected from a group of Fe, Co, Ni, metals of 4*a*, 5*a* and 6*a* of the periodic table and Si, and a second powder of a second component which is capable of self-propagating high temperature synthesis to form with said first component carbide, nitride, boride, silicide or intermetallic compound, said first and second powders being mixed intimately with each other and formed into an axial rod. Another aspect is a method for the production of the electrospark alloying rod, comprising: mixing intimately a first powder of first component and a second powder of second component, said first component comprising at least one selected from Fe, Co, Ni, metals of groups 4*a*, 5*a* and 6*a*, Sn, Zn, Pb, Al and Cu, said second component comprising materials capable of SHS process to form a refractory (or intermetallic) compound, compressing said mixture, followed or not by further firing, and thereby forming an axial body with a bulk density 0.50 to 0.86 time the theoretical values for the corresponding substances. Still another aspect is a method for the deposition of a coating on a work by causing and holding an electric spark between said electrode rod and work, whereby transferring the materials of said first and second components to the surface of said work, and depositing thereon as a layer or more layers of such compound.

40 Claims, 1 Drawing Sheet

ELECTRODE ROD FOR SPARK DEPOSITION, PROCESS FOR THE PRODUCTION THEREOF, AND PROCESS FOR COVERING WITH SUPERABRASIVE-CONTAINING LAYER

Electrode rod for spark alloying, process for preparing the same, and method of depositing a super abrasive containing, coating

TECHNICAL FIELD

This invention relates to an electrode rod for spark alloying, process for preparing the same, and method of depositing a super abrasive containing coating.

TECHNICAL BACKGROUND

The electrospark alloying (ESA) technique is known for the deposition of a wear-resistant coating on the surface of a metallic article. It is based on the material transfer by and in an electronic spark formed between an electrode rod of hard refractory material and work, whereby the former is molten or evaporated at an intense and instantaneous temperature of 3000° to 4000° C. to transfer over and deposit a coating, on the surface of a work, which may be made of iron-, nickel-, or copper-based alloy, or titanium, tantalum or molybdenum metal. It is also known to transfer carbon from the electrode to form carbide of an ingredient transition metal of the work, in order to produce a hardened surface.

The ESA technique is described in several works. Elektronnaya Obrabotka Materialov, No. 4, issued in 1978, for example, discusses at pages 86 to 87 the properties of coatings formed by this technique, while the No. 5, 1991 issue describes at pages 66 to 68 the preparation of an electrode rod by self-propagating high temperature synthesis.

As ESA electrodes are principally made of high-melting compounds, such as carbide and boride, of a transition metal, it is known that the coated surface can exhibit a wear resistance several times as high as the base material does. However there are a very limited number of materials available for this purpose since the inherent high melting points usually limit the rate of transfer to the work surface, and tend hardly to leave a deposit of regular composition. Further the preparation of electrode rods involves some unsolved problems.

The Inventors by now have found that the synthesis and deposition of a coating of various high melting compounds can be successfully achieved by ESA with an electrode rod of some specific compositions.

It has been considered that as the spark discharge produces a temperature of several thousands of degrees, if in a limited zone, metastable substances such as diamond and cubic boron nitride provided there would convert to the stable phases of graphite and hexagonal boron nitride, respectively. In contrast, our experiments have shown that such backward process can be essentially held against the intense heating, if for a limited time.

Now we have developed these techniques of invention in order to provide a solution based on such findings solved those problems.

DISCLOSURE OF INVENTION

This invention provides a solution for those problems, described above, on the basis of a self-propagating high-temperature synthesis (SHS) as applied to the preparation of electrode rods. The invention essentially employs an electrode rod that is made of mixed powder of elemental materials so composed as to enable an SHS process. Thus the invention further provides a method, which consists of just simple basic steps, for the deposition of a coating of high-melting and hard-working material. Also provided is an electrode rod for such purpose.

A first aspect of the invention consists in: an electrode rod for spark alloying, comprising a compact of a first powder of a first component which comprises a metal selected from a group of Fe, Co, Ni, metals of 4a, 5a and 6a of the periodic table and Si, and a second powder of a second component which is capable of self-propagating high temperature synthesis to form with said first component carbide, nitride, boride, silicide or intermetallic compound comprises, said first and second powders being mixed intimately with each other and formed into an axial rod.

A second aspect of the invention consists in: a method for the production of the electrospark alloying rod, comprising: mixing intimately a first powder of first component and a second powder of second component, said first component comprising at least one selected from Fe, Co, Ni, metals of groups 4a, 5a and 6a, Sn, Zn, Pb, Al and Cu, said second component comprising materials capable of SHS process to form a refractory or intermetallic compound, compressing said mixture, followed or not by further firing, and thereby forming an axial body with a bulk density 0.50 to 0.86 time the theoretical values for the corresponding substances.

BRIEF DESCRIPTION OF THE DRAWINGS

FIG. 1(*b*) shows the sectional elevation of an electrode rod of the invention with a casing.

PREFERRED EMBODIMENT OF INVENTION

Figure 1A:
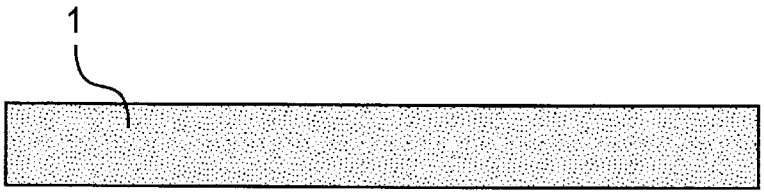
FIG. 1(*a*) shows the sectional elevation of an electrode rod of the invention without a casing.

For the purpose of the invention suitable are compositions that yield intense heat to form high melting compounds such as carbide and boride by SHS, including mixed powders of Ti and C, Ti and B, Zr and C, Ta and C, Ta and B, W and C, W and B, Cr and C, Cr and B, for example.

Also available are combinations capable of forming intermetallic compounds, including, compositions of Ni+Al, Ti+Al, Ti+Si, Cu+Al, Fe+Al, Co+Al, Sn+Al+Cu, Ni+Al+Cu+Ti, Ni+Al+Ti+(C or B), Ti+Si+Al. While these combinations commonly yield rather small heat volume and sometimes insufficient by themselves for sustaining an SHS process, they are now available as assisted by ESA for achieving the deposition of a high performance coating of such compounds.

Thus the coating of the invention may be composed of a wide range of high melting and hard materials including: carbide, nitride, boride, oxide, chalcogenide, silicide, and intermetallic compounds of transition metals. They are used as a completely mixed powder of each element and formed into an axial body or rod, to be brief. As an SHS process is operated under an electric discharge spark, and, thereby transferring reactant materials and depositing as a coating of the compound. The reaction heat emitted in the process serves as an auxiliary heat source for both sustaining the process and melting the coating materials.

Among transition metals especially effective are Ti, Zr, Hf, Cr, Ta, Nb, Mo and W, as well as Fe, Co, Ni and Si for an SHS process. They may be used singly or in combination with another or others. C, B and Si are useful in combination with such metals for forming a stable high melting compound with an intense heat emission.

These compositions are available and in particular suitable for depositing coatings as capable of yielding a sufficient volume of heat by an SHS process and at the same time forming coatings of hard materials: Ti+C, Ti+2B, Ti+C+Si, Ti+2B+Si, Zr+C, 2Nb+C, Ta+C, and Zr+Si. Each of the combinations yields abundant reaction heat in the formation of corresponding compounds, which will be produced as a result of the complete propagating process, within several seconds of the ignition at an end of the compacted powder.

On the other hand, intermetallic forming elements to be combined with a transition metal include Al, Ni, Co and Fe. While less heat is available from the formation of intermetallic compounds than in the case of carbide or boride, the processes can be effectively used in the method of the invention as an auxiliary heat source to add to the heat of the SHS process and to improve the homogeneity of resulting coatings.

In the invention electrodes may be formed by compacting mixed powder of various SHS compositions by conventional techniques, so a coating of wide range of high melting high hardness compounds can be thereby deposited on the surface of structural parts, tool tips, etc.

Some neutral substances, irrelevant to the SHS process involved, may be contained in the electrode as far as the heat supply by electric discharge and SHS can afford. In such case the added content should be between 3 to 70% by volume. Over the 70% limit, the SHS will slow down with the too much part of inactive component in the material being transferred from the electrode to the work, while below the 3% limit, the additive usually cannot take an obvious effect.

The nature and quantity of additive should be determined from the target coating properties, adhesion to the work surface, and uses of the treated product.

For the purpose of improvement of coating toughness and shock load resistance additives are selected from carbide, nitride, boride, oxide, chalcogenide, silicide and intermetallic compounds of transition metals, for example TiN, TiC, $TiB_2$, TaC, $ZrB_2$, NbC, AlN, AlB, $Cr_3C_2$, $Al_2O_3$, $ZrO_2$, $MoS_2$, $MoSe_2$, $WSe_2$, $Ti_5Si_3C_x$, $Ti_3SiC_2$, and WC. It is considered that they take off from the electrode and land on the work as a compound.

Alloying processes are also available for the coating of the invention between an electrode component and a material provided on the work in advance, by coating, metallic foil application, and so forth. For example a TiC—Ni based hard coating can be deposited by a combined ESA-SHS process, which is taken place between an electrode of Ti and C mixed powder compact and a nickel sheet arranged on a SUS grade stainless steel work.

Superabrasive particles of diamond or cubic boron nitride may be admixed to the powder of carbide, nitride or boride, in order to impart the coating with an increased wear resistance. While particle sizes of 5 to 1000 $\mu$m are available in general, over 10 $\mu$m sizes are preferable when taking into consideration the oxidation and backward phase transition in the ESA reaction zone, but not exceeding 100 $\mu$m, from the view point of securing a reasonable surface flatness for the hardened coating.

Such coatings are normally contained as a filling component in the electrode. It is also possible for the purpose of facilitation to spread over the work surface, in the place of addition to the electrode, in advance to the deposition process and fixing there with the melt that forms during the ESA-SHS process.

It may be concerned that the high temperatures involving in an ESA or SHS process should accelerate the phase transition to the stable phases of the diamond or and cubic boron nitride, as being metastable at room temperature (the atmospheric pressure). In fact they remain essentially unaffected due to the extremely short duration of several seconds of such high temperatures. Oxidation, on the other hand, should be avoided as accelerating such transition. In this context is especially effective provision for the deposition zone an atmosphere of inert gas, such as argon and nitrogen.

The deposition method of the present invention can be employed for securing various superabrasive particles. It is desirable for wear resistant uses that such particles to be contained in the electrode should have a size as small as possible on the condition that they undergo the transition to the lower pressure phase under the intense heat of SHS. Coarser particles of 500 $\mu$m or more also can be effectively secured to the work by the deposition of the invention as method a substitution for electroplating.

Rather coarse particles can be contained in the deposit by either simply spreading them on the work surface or holding by indention or electric or electroless plating, followed by the ESA deposition. In this case good adhesion can be attained between the diamond and the work by using an electrode composed of group 4 to 6 transition metals, in order to provide there a chemical combination by means of a film of carbide, which forms on the diamond surface.

ESA-SHS electrodes of the invention preferably may comprise, besides diamond, Ni+Al, Ti+Al, Co+Al, Ti+C(or B)+Al+Ni as principal components. Such electrode compositions may comprise further additives given below. Diamond particles may be contained in the composition at a concentration of 5 to 60% by volume of the whole composition, including diamond itself. The effect is not significant at a concentration less than 5%, while over 60% diamond reduces heat generation to a level where the deposition process cannot be effectively maintained or the decreased proportion of the coating material may be insufficient for securing such large proportion of diamond particles.

This invention also provides an electrode and a coating method therewith that provide positively liquid phase in the zone where the deposition is taken place. Coatings formed by the ESA technique is an agglomeration of hard particles with diameters of several micrometers, so repeated deposition cycles may be necessary for the production of a smooth, continuous coating. Thus a solution is also provided to this problem by the formation of abundant liquid phase in the reaction zone. Material transfer from the electrode to the work surface is promoted as diffusion through the liquid is available, to yield the effects: improvement of both continuity and thickness of the coating, and increased transition layer thickness which reduces stresses at the interface between the coating and work. For this particular purpose is effective use as a component in powder of at least a metal or an alloy with a melting point of 1000° C. or less. Particularly suitable are metals of Cu, Sn, Zn, Pb and Al, and alloys thereof.

When such low melting metals or alloys are present, along with other components, liquid phase is provided between the electrode and work surface during the ESA process, transfer of electrode components to the work surface is significantly accelerated with liquid phase diffusion available. Thus a significantly increased coating thickness of 10 to 100 μm or even more can be readily achieved, as compared with conventional ESA techniques which commonly achieve 10 μm or less, and have never attained such a thickness exceeding 100 μm. At the same time a significant improvement is achievable also in the surface flatness and continuity of the coating, with a wider range of uses as a wear resistant material. In the method of the invention the work surface dissolves into the melt to yield a transition layer thickness on the work, which can be increased up to 10 μm.

When carbide or nitride of a transition metal is contained as a hard component in the coating, metallic materials containing nickel or cobalt should be preferably used for consisting the matrix to hold the component. In this case nickel and cobalt each can be contained in the electrode as a pulverized additive at a concentration of up to 30 volume %. Higher contents of Ni or Co accordingly reduce the proportion of SHS components, so the heat supply available in the reaction zone decreases to a level insufficient for maintaining the process, and also the coating hardness decreases as a result of accordingly increased proportion of softer components.

The addition of Ni or Co to the electrode composition is favorable also in that a good adhesion is attained between the coating and work as made of common iron based material.

SHS components may be used in either clad powder or gathered or separated fibers, in order to provide an increased surface area and thus an improved reactivity. The increased surface is favorable for the formation of electrodes due to an interaction expected between such particles. Combinations of metals available as a clad powder include 3Ni+Al, Ti+Al, 3Nb+Al and Fe+Al, for example.

The ESA electrode of the invention may consist of mixed powder of various components as described above and used in the form of a rod either as formed or further fired. A wide range of conventional powder forming techniques is available for the preparation of such electrode rods, and extrusion forming appears best suited for the purpose. These techniques can be also used: die forming, CIP, HIP, hot pressing and slip casting that uses an organic solvent.

Since the mixed powder to be formed may contains some elements that are capable of forming stable oxide or nitride at high temperatures, the process should be operated either in a high vacuum or in an inert gas atmosphere of argon or helium, in the case when an auxiliary heating is effected or the process involves a significant exothermic reaction.

Some techniques from the powder metallurgy are also effective for the formation of rods, such as addition of powder of a low melting metal such as Cu, Sn or Zn, which is molten after the formation to impregnate the formed body of rod, in order to increase the mechanical strength. The impregnation from outside of low melting metal is likewise applicable for the same purpose.

The electrode rod is suitably finished to a bulk density of 0.50 to 0.86. At densities below 0.50 the rod does not have strength sufficient for the ESA process. Compact electrodes of a density over 0.86, on the other hand, are not suitable, as they tend to undergo an excessive heating due to the high thermal conductivity during the ESA process, so an SHS process eventually is caused within the electrode.

Figure 1B:
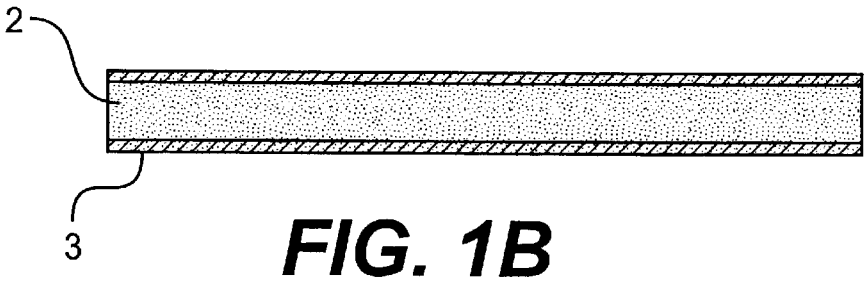

The ESA electrode may be prepared and used as a cylindrical rod, as schematically illustrated in FIGS. 1(*a*) and (*b*), with a 2 to 5 mm diameter and a 40 mm or more length. As shown in FIG. 1(*a*), the body 1 of compacted powder may be bare. Alternatively, the body 2 may be covered with a casing 3 of such ductile metal as copper or aluminum.

The deposition process is operated by causing a relative motion between the electrode and work, with either one movable while the other stationary, whereby the former may scan over the latter. While a continuous sparking may be often achieved when an interval of 1 mm or less is maintained between the electrode and work, it is secured when necessary by causing a tender relative vibration of, say 60 Hz, between them. A discharging energy input of 0.01 to 5 joules is suitable for the process. An energy input below 0.01 J is not sufficient for initiating and maintaining the material transfer. An excessive energy over 5J leads an intense heating of the electrode and eventually to an SHS process to form compounds within the electrode itself, so it becomes difficult or impossible to achieve the object of the invention of an efficient heating by the combination of ESA and SHS and, thereby, deposition of such compounds on the work surface.

The ESA technique often uses a multi-layer coating in order to achieve a required thickness. In such cases both high surface hardness of the coating and good adhesion to the work can be attained at the same time in a functionally graded material, with a diamond-containing electrode, in particular and discharge energy levels that decrease stepwise from the bottom over to the top layer deposited. A higher energy is put in the adjacency with the work surface to convert the diamond in part to graphite and, thereby, increase the adhesion and decrease the internal stresses. Less energy is applied for the top layer in order to leave the substantial part of diamond free of conversion and, thereby, provide a high surface hardness.

Some irregularity may be inevitable in the composition or construction of the coating by the ESA-SHS process of the invention with substantial stresses left within, as a result of the quick cooling of the process product. It is thus preferable that the deposited coating be annealed as necessary and sometimes further machined, in order to improve the regularity, surface flatness and continuity of the coating, or release the internal stresses.

Various materials may be effectively used as components for the electrode of the invention. Some of them are summarized in the tables below.

TABLE 1

| Examples of SHS components alone (The factores in molar ratio) |
|---|
| Ni + Al |
| Ti + Al |
| Ti + 2B |
| Zr + Ni |
| Nb + 2B |

TABLE 2

Examples of SHS components with low melting metals

| SHS components | Low melting metallic composition vol. % | Note |
|---|---|---|
| Ti + C | 10% (Al-Ni) | 200 μm, approx. clad powder |
| Ti + 2B | 10% Sn | |
| 3Cr + 2C | 5% Zn | |
| Ta + 2Si | 7% Cu + 3% Zn | 200 μm × 5 mm fiberous powder |
| Nb + C | 9% Cu + 1% Sn | |
| W + B | 7% Cu + 3% Pb | |
| Mo + B | 10% Sn | |
| Mo + B | 10% Al | |

TABLE 3

Examples of SHS compositions with a filler

| SHS components (factors in molar ratio) | Low melting metal composition vol. % | Additive vol % |
|---|---|---|
| Ti + Al | | 20% $Al_2O_3$ |
| Ti + Ni | | 30% $Cr_3C_2$ |
| Ni + Al | | 15% TiN |
| Ni + Mo | | 20% TaC |
| Ti + 2Si | 10% Al | 20% $Si_3N_4$ |
| V + C | 9% Cu + 1% Sn | 25% $Si_3N_4$ |
| Ti + C | 10% Cu | 30% $MoS_2$ |

TABLE 4

Examples of compositions with superabrasive

| SHS components (factors in mol. ratio) | Low melting metals vol % | Additive vol. % ceramics | superabrasive | size μm |
|---|---|---|---|---|
| Ti + B | | | 25% diam. | 10/20 |
| Ti + 2Si | | | 25% c-BN | 12/25 |
| Ni + Al | | 10% AlN | 20% diam. | 8/16 |
| Ti + C | 10% Cu | — | 20% diam. | 40/60 |
| Ti + Ni | 5% Sn | | 20% c-BN | 20/30 |
| Ti + C | 10% Al | | 25% diam. | 10/20 |
| Co + Al | | 15% NbC | 25% c-BN | 8/16 |
| Ti + Al | | 25% WC | 20% diam. | 12/25 |

Figure 2:
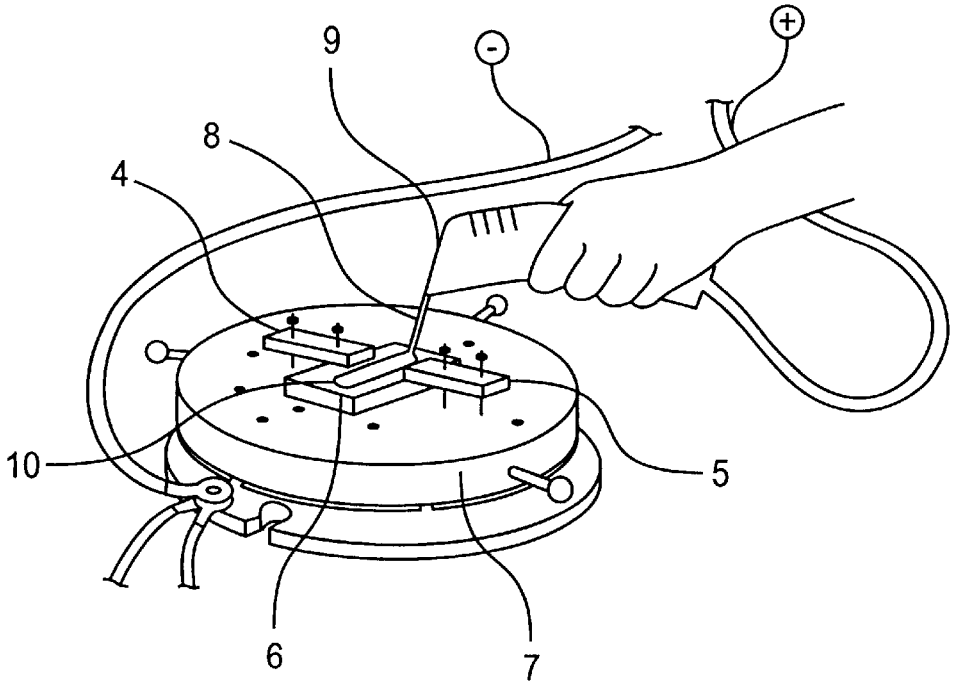
FIG. 2 shows the schematic illustration of an ESA process as conducted in one of the examples of the invention.

Now the invention will be described in particular by means of examples. In the examples and preliminary tests 1–3 employed were powders of 20 μm Ni, 10 μm Al, 30 μm Fe, 1 μm TiN and 10 μm $TiB_2$ for composing electrodes of 5 mm diameter and 50 mm length. As schematically shown in FIG. 2, the work 6 was fixed with a clamp 4,5 to a work table 7, and a coating 10 was deposited manually on the work 6 surface, with an electrode rod 8 supported in a holder 9. An Elitron-52B type power supply (not shown) was used for the electrospark deposition.

EXAMPLE 1

A coating, of NiAl and TiN was formed on the work surface of a 30 by 30 by 5 mm block of GS6U nickel alloy, and both wear resistance per unit surface area and oxidation resistance were evaluated against the observed relative density (to the calculated value being 100) of the coating. Five electrodes were prepared using 100 volume parts of equimolar mixed powder of nickel and aluminum, which was admixed with 30 parts of TiN, and formed into compacts in a metallic die. The relative density of the rods was varied by means of the temperature they were fired. The discharge energy input and the deposition rate were fixed at 0.3 J and 1 $cm^2$ per minute, respectively. The were lightly vibrated at 100 Hz relative to the work surface, while an estimated 10μm gap, approximately, was maintained during the discharge between the work surface and electrode tip.

| Run No. | Relative Density | Weight Increase: g/$cm^2$ (900° C. × 10 hrs) | Wear Resistance: m (1 kgf) |
|---|---|---|---|
| 1 | 90 | 1.0 | 145 |
| 2 | 86 | 0.5 | 160 |
| 3 | 70 | 0.2 | 175 |

-continued

| Run No. | Relative Density | Weight Increase: g/$cm^2$ (900° C. × 10 hrs) | Wear Resistance: m (1 kgf) |
|---|---|---|---|
| 4 | 50 | 0.2 | 175 |
| 5 | 45 | broken because of insufficient strength | |

The wear resistance was examined in the grinding of corresponding sample blocks with a specific diamond wheel and evaluated as the length run by the wheel periphery before the wear depth of the sample reaches 40 μm. For the tests used was a wheel that contained, nominal 10–30 μm diamond particles at a concentration of 100 (25 volume %) as metal-bonded. The contact area of the sample with the wheel was set at 33 $mm^2$, while a 1 kgf load was used for pressing to the wheel.

EXAMPLE 2

The relationship was determined between the discharged energy and resulting deposit thickness and continuity in several cycles of ESA-SHS process. The electrode rod was made up of equimolar mixed powder of Fe and Al, admixed with 35 vol. % $TiB_2$ powder, formed at an 80% relative density. Coatings were deposited in argon at a rate of 1 $cm^2$ per minute.

| Run No. | Discharge Energy Joules | Coating Thickness μm | Coating Continuity % |
|---|---|---|---|
| 1 | 0.009 | 2–3 | 50 |
| 2 | 0.01 | 5–10 | 90–95 |
| 3 | 0.1 | =/<30 | 95–100 |
| 4 | 5.0 | =/<250 | 95–100 |
| 5 | 5.5 | =/<100 | 80 |

EXAMPLE 3

Electrode rods were prepared from an equimolar mixed powder of Ni and Al, admixed with 30 to 40 μm diamond. Coatings were deposited in argon at a rate of 1 $cm^2$ per minute, and evaluated in wear resistance of the deposited coatings. The test was conducted with GS6U nickel alloy works, as example 1, at a fixed energy input of 0.1 J. The wear resistance was evaluated by the same procedures as in example 1.

| Run No. | Electrode Rel. Density: % | Deposit Thickness: μm | Electrode Diamond Content: vol. % | Wear Resistance |
|---|---|---|---|---|
| 1 | 60 | 280 | 2 | 200 |
| 2 | 60 | 250 | 3 | 250 |
| 3 | 58 | 250 | 25 | 500 |
| 4 | 55 | 200 | 70 | 800 |
| 5 | 50 | 50 | 75 | 40 |

EXAMPLE 4

The starting material was a completely mixed powder with a particle size of or less than 20 μm each, which consisted of 75% by weight of equimolar Ni and Al mixture, 10% copper and 15% 12 to 25 μm diamond. It was further admixed with 15% paraffin wax, kneaded and then extruded to form into 3-mm diameter cylindrical rods, which were further de-waxed and fired in hydrogen at 600° C., in order to prepare electrodes of relative density of about 70%.

The electrode rods were used to form coatings. The work was a JIS SUS stainless ring, with 75 mm O.D., 50 mm I.D. and 5 mm thickness and was placed on a rotary table. An approximate 100 μm thick coating was deposited on the work with the electrode progressed, under a light contact pressure, at a rate of 3 mm per minute, while the table was rotated at 10 r.p.m. The ring as recovered was annealed in nitrogen at 400° C. for two hours in order to remove deformation and, in the end, used as a rotary seal for a sand pump.

EXAMPLE 5

We are showing three cases where wear-resistant coatings were formed on the surface of a lathe centers as a work. The coated parts achieved a service life 5 to 10 times relative to that of cemented tungsten carbide.

1. The work consisted of JIS SK-3 steel and had a 12.5 mm diameter and an 18 mm length, with a conical end with a 60 degree apex. The electrode was prepared by filling a 1 mm thick walled 10 mm O.D. copper tube that was filled with mixed powder of 60% by volume of equimolar, or with a 1:1 molar ratio, mixed powder of Ni and Al, admixed with 60% 20/30 μm diamond, and finished by drawing to a 3.2 mm O.D. rod. A four-layered coating with, each, an average 15 μm thickness was deposited by moving the electrode around the conical surface, while rotating the work at 30 r.p.m. The layer structures were varied by using different discharge currents: 4.0 A for the innermost, 3.0 A for the second, 2.0 A for the third, and 1.0 A for the fourth, or outermost. Graphite was enriched in a zone closer to the work body, while the surface zone virtually contained diamond alone, so as to improve the adherence to the work body and at the same time to reduce the stresses remaining within the coating.
2. Electrode rods were prepared by the same procedures as in the first case. A 10 mm O.D. brass tube was filled with equimolar mixed powder of Ni and Al, admixed with 60 vol. % 8/16 μm diamond powder, and finished to a 4.0 mm diameter rod. The work consisting of WC-10%Co, with the same dimensions as above, was deposited with two-layered coating, with the first, or bottom, formed at a discharge current of 3.0 A, while the surface layer at 1.0 A.
3. A 4.0 mm O.D. electrode rod was prepared using an aluminum tube casing and 30/40 μm diamond. The work of SK-3 steel was first deposited on the surface with a Ti layer to a 5 μm, approx. thickness, by electrospark alloying technique and then an approximate 50 μm thick coating layer.

EXAMPLE 6

A case for the substituting purpose for the electrodeposition technique as employed in the preparation of an abrasive tool.

In each case described below, the electrodes had a size of 3.2 mm diameter and a 40 mm length, with the mixed powder, formed at a relative density of about 75%. Diamond was used as an abrasive material, which was fixed on the work surface by electroplating with thin nickel film.

1. A brass casing was filled with equimolar mixed powder of Ti and Ni to form an electrode rod. A work was prepared using a 75 mm diameter disk of SUS stainless steel and depositing on it with 40/50 mesh diamond particles, which were held provisionally and scattered at a density of about 50%. An approximate 300 μm thick coating was formed on the work, in order to secure the diamond by means of the electrode, and a grinding sander was thus obtained.
2. An electrode was prepared using an aluminum casing filled with mixed powder of Cr and Ni of 1:5 molar ratio. A work was prepared from a 1.2 mm thick, 125 mm diameter circular plate of SUS grade stainless steel, by depositing and holding provisionally 140/170 mesh diamond particles over a 3-mm wide area around the periphery. The disk was further deposited with an approximate 100 μm thick coating to secure the diamond, which was effectively used as a blade for cutting glass sheets.
3. An electrode was prepared using a copper casing filled with equimolar mixed powder of Ni and Al. A work was prepared from a 0.8-mm thick walled, 12.5-mm O.D. pipe of SK grade carbon steel. An approximate 10 μm thick titanium metal coating was formed by ESA over the end surface of the pipe, followed by 270/325 mesh diamond particles, which were held provisionally, finally with an about 60 μm coating. The tool thus produced was effectively used as a core drill for ceramic materials.

Based on the novel characteristic features specifically described above, the present invention performs, among others, these achievements:

1. As the electrode contains a composition that is capable of an SHS (self propagating high temperature synthesis) process and a high temperature produced thereby permits reduction in discharge energy input in the ESA (electrospark alloying) process between the electrode and the work.
2. The simultaneous SHS process promotes the deposition of coatings by ESA, with an increase in rate by a factor of 3 to 4 over the conventional technique.
3. The assistance by the heat of SHS process increases the total heat generation in the course of ESA process. It is thus allowed that the electrode contain some hard materials, if they would not contribute to heat production, for the purpose of improvement in the resistance to abrasive wear or heat of the deposited coatings.
4. A one step technique for forming a rather thick coating can be readily achieved, along with an improved deposit homogeneity, by admixing to the electrode metallic ingredients which are capable of melting under the heat of the process.
5. A transition layer can be achieved in the work with increased thickness, so as to improve the coating adhesion.

Applicability in Industry

The technique of this invention is effectively applicable to the electrode rod, method for its production, and the deposition of superabrasive containing coatings.

What is claimed is:

1. An electrode rod for spark alloying, comprising a compact of a first powder of a first component which comprises a metal selected from the group consisting of Fe, Co, Ni, metals of 4a, 5a and 6a of the periodic table and Si, and a second powder of a second component which is capable of self-propagating high temperature synthesis to form with said first component carbide, nitrate, boride, silicide or intermetallic compound, said first and second powders being mixed intimately with each other and formed into an axial rod.

2. The rod as claimed in claim 1, in which said first component comprises at least one metal selected from the group consisting of Ti, Zr, Hf, Cr, Ta, Nb, Mo and W, and at the same time said second component comprises at least one component selected from the group consisting of C, B and Si.

3. The rod as claimed in claim 1, in which the mixed powder of said first and second powders further comprises SHS-neutral material at a content of 3 to 70% by volume of the first and second components combined.

4. The rod as claimed in claim 3, in which said neutral material comprises a material selected from the group consisting of carbide, nitride, boride, oxide, chalcogenide, silicide, intermetallic compounds of a transition metal, superabrasive materials, and metals that have a melting point of or less than 1000° C.

5. The rod as claimed in claim 4, in which said rod comprises said superabrasive material at a proportion of 5 to 60 Vol. % in relation to said first and second powders combined.

6. The rod as claimed in claim 4, in which said superabrasive material consists of particles of a size from 10 to 1000 $\mu$m.

7. The rod as claimed in claim 4, in which said superabrasive material comprises a material selected from the group consisting of diamond and cubic boron nitride.

8. The rod as claimed in claim 1, in which said compact further comprises a metallic material with a low melting point, intimately mixed with both the first and second components.

9. The rod as claimed in claim 1, in which the mixture of said first and second components is packed in a cylindrical container of low melting metallic material.

10. The rod as claimed in claim 8, in which said low melting metallic material comprises at least one material selected from the group consisting of Cu, Sn, Zn, Pb and Al.

11. The rod as claimed in claim 1, in which said compact has a bulk density 0.50 to 0.86 time the theoretical value for the corresponding substances.

12. A method for the production of the electrospark alloying rod, comprising: mixing intimately a first powder of a first component and a second powder of a second component, said first component comprising at least one metal selected from the group consisting of Fe, Co, Ni, metals of groups 4a, 5a and 6a, Sn, Zn, Pb, Al and Cu, said second component comprising materials capable of SHS process to form a refractory or intermetallic compound, compressing said mixture, followed or not by further firing, and thereby forming an axial body with a bulk density 0.50 to 0.86 times the theoretical values for the corresponding substances.

13. The method as claimed in claim 12, in which the mixed powder of said first components and second components is filled in the cylindrical container of low melting metallic material and then whole is drawn into a cylindrical rod of given diameter.

14. The method as claimed in claim 12, in which said powders of first and second components are mixed and compressed, and then a metal of low melting point is molten and penetrated into the compressed powder to form an electrode.

15. The method as claimed in claim 13, in which said low melting metallic material comprises at least one material selected from the group consisting of Cu, Sn, Zn, Pb and Al.

16. The method as claimed in claim 12, in which said first component comprises at least one component selected from the group consisting of Ti, Zr, Hf, Cr, Ta, Nb, Mo and W, and said second component comprises at least one component selected from the group consisting of C, B, Si, Al, Fe, Co and Ni.

17. The method as claimed in claim 12, in which either of said first and second components consists of particles of a nominal size not exceeding 30 $\mu$m.

18. The method as claimed in claim 17, in which either said first or second component consists of clad powder or fibers that are either separated individually or in agglomerated groups.

19. The method as claimed in claim 12, in which said first and second components are mixed in the presence of 3 to 70%, by volume, of third component that is neutral to the SHS process involved.

20. The method as claimed in claim 19, in which said third component comprises at least one material selected from the group consisting of carbide, nitride, boride, oxide, chalcogenide and silicide of transition metals, diamond, cubic boron nitride and metallic materials which have a melting point less than 1000° C.

21. The method as claimed in claim 12, in which said first and second powders are mixed and formed by either extrusion in a vacuum, isostatic pressing at a temperature where no liquid phase occurs, slip casting or hot pressing.

22. The method as claimed in claim 12, in which said first and second powders are mixed and formed at a temperature where molten metal occurs from a metallic material contained in said components as mixed.

23. The method as claimed in claim 12, in which said first and second powders are mixed and formed by powder metallurgy.

24. A method for the deposition of a coating on a work which comprises: providing an electrode rod, which consists of compacted and intimately mixed powder of a first component comprising at least one metal selected from the group consisting of Fe, Co, Ni, metals of groups 4a, 5a and 6a and Si, and a second powder of a second component which is capable of SHS to form with said first component carbide, nitride, boride, silicide or intermetallic compound, using said electrode rod in order to cause and hold an electric spark between said electrode and work, transferring thereby materials of said first and second components to the surface of said work, and depositing thereon as a layer or more layers of such compound.

25. A method for the deposition of a coating on a work which comprises: providing an electrode rod, which consists of compacted and intimately mixed powder of a first component comprising at least one metal selected from the group consisting of Fe, Co, Ni, metals of groups 4a, 5a and 6a and Si, a second powder of a second component which is capable of SHS to form with said first component carbide, nitride, boride, silicide or intermetallic compound, and an SHS-neutral component which comprises a material selected from the group consisting of carbide, nitride, boride, oxide, chalcogenide, silicide, intermetallic compounds of a transition metal, diamond and cubic boron nitride, and metallic materials that have a melting point of or less than 1000° C., using said electrode rod in order to cause and hold an electric spark between said electrode and work, transferring thereby materials of said first and second components to the surface of said work, and depositing thereon as a layer or more layers of such compound and at the same time particles of said SHS-neutral material.

26. The method as claimed in claim 24, in which said electrode is used as a compacted powder in unfired condition.

27. The method as claimed in claim 24, in which said electrode is used as a compacted powder in sub-fired condition.

28. The method as claimed in claim 24, in which said electric spark process is operated at a discharging energy input of 0.01 to 5 joules.

29. The method as claimed in claim 24, in which several layers of coating are deposited at different levels of discharging energy, with the inner layer, which is adjacent to the work surface, at an approximate 5 joules, while the outermost or top layer at something less than 1 joule and close to the lower limit.

30. The method as claimed in claim 24, in which the electric spark process is operated in an atmosphere of either inert or nitrogen gas.

31. The method as claimed in claim 24, in which said coating as recovered from the electric spark process is machined or annealed in heat and, thereby, improving the flatness or continuity of the deposit or reducing the internal strain.

32. The method as claimed in claim 25, in which said electric spark process is operated using an electrode rod which contains diamond particles, said innermost layer is deposited at a higher temperature and thereby providing therein a higher graphite content, while said outermost layer is deposited at a lower temperature to provide therein a lower graphite content, thereby providing a gradient in graphite content increasing stepwise from the innermost to outermost layer.

33. The method as claimed in claim 24, in which said work is first deposited with diamond particles, which are deposited over with a coating by electric spark process, thereby securing said diamond particles on the work surface.

34. The method as claimed in claim 25, in which said electrode is used as a compacted powder in unfired condition.

35. The method as claimed in claim 25, in which said electrode is used as a compacted powder in sub-fired condition.

36. The method as claimed in claim 25, in which said electric spark process is operated at a discharging energy input of 0.01 to 5 joules.

37. The method as claimed in claim 25, in which several layers of coating are deposited at different levels of discharging energy, with the inner layer, which is adjacent to the work surface, at an approximate 5 joules, while the outermost or top layer at something less than 1 joule and close to the lower limit.

38. The method as claimed in claim 25, in which the electric spark process is operated in an atmosphere of either inert or nitrogen gas.

39. The method as claimed in claim 25, in which said coating as recovered from the electric spark process is machined or annealed in heat and, thereby, improving the flatness or continuity of the deposit or reducing the internal strain.

40. The method as claimed in claim 25, in which said work is first deposited with diamond particles, which are deposited over with a coating by electric spark process, thereby securing said diamond particles on the work surface.

* * * * *